US006984014B2

(12) United States Patent
Baiges

(10) Patent No.: US 6,984,014 B2
(45) Date of Patent: Jan. 10, 2006

(54) INKJET PRINTING SYSTEM EMPLOYING MULTIPLE INKJET PRINTHEADS AND METHOD OF PERFORMING A PRINTING OPERATION

(75) Inventor: Ivan J. Baiges, Mayaguez, PR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 289 days.

(21) Appl. No.: 10/057,619

(22) Filed: Jan. 24, 2002

(65) Prior Publication Data

US 2003/0137550 A1 Jul. 24, 2003

(51) Int. Cl.
*B41J 2/015* (2006.01)
*B41J 23/00* (2006.01)

(52) U.S. Cl. ..... 347/20; 347/37

(58) Field of Classification Search ..... 347/37; 400/82, 283, 320, 353; 346/44; 257/314, 257/315, 316, 317, 318, 319, 320, 321, 322, 257/323, 324, 325, 326; 438/257–258, 266, 438/242, 201

See application file for complete search history.

(56) References Cited

U.S. PATENT DOCUMENTS

| | | | | |
|---|---|---|---|---|
| 4,910,871 | A * | 3/1990 | Logan | 33/18.2 |
| 4,940,998 | A * | 7/1990 | Asakawa | 347/37 |
| 5,016,023 | A | 5/1991 | Chan et al. | 347/42 |
| 5,357,268 | A | 10/1994 | Kishida et al. | 347/13 |
| 5,376,957 | A * | 12/1994 | Gandy et al. | 347/3 |
| 5,398,053 | A | 3/1995 | Hirosawa et al. | 347/13 |
| 5,428,375 | A * | 6/1995 | Simon et al. | 347/12 |
| 5,677,719 | A * | 10/1997 | Granzow | 347/103 |
| 5,719,602 | A | 2/1998 | Hackleman et al. | 347/14 |
| 5,730,049 | A * | 3/1998 | Broschart | 101/91 |
| 5,742,305 | A | 4/1998 | Hackleman | 347/42 |
| 5,838,343 | A * | 11/1998 | Chapin et al. | 347/22 |
| 5,984,450 | A | 11/1999 | Becker et al. | 347/24 |
| 6,000,781 | A * | 12/1999 | Akiyama et al. | 347/40 |
| 6,164,747 | A * | 12/2000 | Yashima et al. | 347/15 |
| 6,318,840 | B1 * | 11/2001 | Sette et al. | 347/37 |
| 6,593,953 | B1 * | 7/2003 | Ross et al. | 347/221 |

FOREIGN PATENT DOCUMENTS

| | | | |
|---|---|---|---|
| EP | 0145025 | A2 | 6/1985 |
| EP | 0829368 | A2 | 3/1998 |
| EP | 1184188 | A2 | 3/2002 |
| JP | 56005775 | A | 1/1981 |
| JP | 60032680 | A | 2/1985 |
| JP | 61246067 | A | 11/1986 |
| JP | 62028268 | A | 2/1987 |
| JP | 4179561 | A | 6/1992 |

OTHER PUBLICATIONS

Copy of United Kingdom Search Report mailed Feb. 7, 2003 (3 pgs.).

* cited by examiner

*Primary Examiner*—Thinh Nguyen

(57) ABSTRACT

A printing system for depositing ink on print media. The printing system includes first and second printhead assemblies. The first printhead assembly deposits ink only on a first portion of the print media. The second printhead assembly deposits ink only on a second portion of the print media that is different than the first portion.

43 Claims, 11 Drawing Sheets

INKJET PRINTING SYSTEM EMPLOYING MULTIPLE INKJET PRINTHEADS AND METHOD OF PERFORMING A PRINTING OPERATION

TECHNICAL FIELD

This invention relates generally to inkjet printing devices. In particular, the present invention is an inkjet printing system having multiple printheads for depositing ink droplets onto print media to form images and text on different areas of the print media at the same time. The use of multiple printheads printing at the same time on different portions of the print media results in greatly increased print media throughput for the inkjet printing system.

BACKGROUND OF THE INVENTION

Throughout the business world, inkjet printing systems are extensively used for image reproduction. Inkjet printing systems frequently make use of one or more inkjet printheads mounted within a carriage that is moved back and forth across print media, such as paper. For example, the carriage may include a single printhead that is capable of printing a single color (i.e., black), a single printhead capable of printing multiple colors (i.e., black, cyan, magenta and yellow), a first printhead capable of printing one color (i.e., black) and a second printhead capable of printing multiple colors (i.e., cyan, magenta and yellow), or four printheads each capable of printing a single color. As the carriage is moved across the print media, a control system activates the printhead(s) to deposit or eject ink droplets onto the print media to form images and text. Such systems may be used in a wide variety of applications, including computer printers, plotters, copiers and facsimile machines.

Ink is provided to the printhead(s) mounted to the carriage by one or more supplies of ink that are either carried by the carriage or mounted to the printing system such that the supplies of ink do not move with the carriage. For the case where the ink supplies are not carried with the carriage, the ink supplies can be in fluid communication with the printhead(s) to replenish the printhead(s) or the printhead(s) can be intermittently connected with the ink supplies by positioning the printhead(s) proximate to a filling station to which the ink supplies are connected whereupon the printhead(s) are replenished with ink from the refilling station.

For the case where the ink supplies are carried with the carriage, one ink supply may be integral with each printhead whereupon the entire printhead and ink supply is replaced when ink is exhausted. Alternatively, the ink supplies can be carried with the carriage and can be separately replaceable from the printhead(s).

For convenience, the concepts of the invention are discussed in the context of thermal inkjet printheads. A thermal inkjet printhead die includes an array of firing chambers having orifices (also called nozzles) which face the print media. The ink is applied to individually addressable ink energizing elements (such as firing resistors) within the firing chambers. Energy provided by the firing resistors heats the ink within the firing chambers causing the ink to bubble. This in turn causes the ink to be expelled out of the orifice of the firing chamber toward the print media. As the ink is expelled, the bubble collapses and more ink is drawn into the firing chambers, allowing for repetition of the ink expulsion process.

Typically to increase print media throughput (i.e. to increase the speed of printing per page of print media), it is to necessary to increase the firing rate of the firing chambers, maximize the density of the firing chambers (i.e. firing resistors) and/or increase the number of firing chambers. With regards to increasing the firing rate of the firing chambers, the ability to do this somewhat limited by ink composition and the heat generated by the process of repeatedly firing the firing chambers. Hence, the ability to increase the print media throughput of a printing system by increasing the firing rate of the firing chambers of the printhead(s) is somewhat limited given the already high firing frequency of printhead firing chambers.

Maximizing the density of the firing chambers and/or increasing the number of firing chambers to increase print media throughput, typically necessitates an increase in the size of the printhead die and/or a miniaturization of printhead die components. With regards to miniaturization of the printhead die components, once a certain degree of miniaturization has been reached, conventional manufacturing by assembling separately produced components becomes more difficult and costly. In addition, the substrate that supports firing resistors, the barrier that isolates individual resistors, and the orifice plate that provides a nozzle above each resistor are all subject to small dimensional variations that can accumulate to limit miniaturization. Further, the assembly of such components for conventional printheads requires precision that limits manufacturing efficiency. Hence, increasing the print media throughput of a printing system by miniaturization of printhead die components of the printhead(s) is somewhat limited by manufacturing practicalities and costs.

With regards to increasing the size of the printhead die to increase print media throughput, printheads employing Page Wide Arrays (PWA's) have already been developed. In a PWA printhead, the firing chambers extend across the full width of the print media thereby eliminating the need of the carriage supporting the PWA printhead to be moved back and forth across the print media. In other words, to perform a full page printing operation using a PWA printhead, the print media need only be stepped past the PWA printhead while the PWA printhead remains stationary. This elimination of the movement of the PWA printhead results in an increase in print media throughput. Although the use of a PWA printhead increases print media throughput, there are some disadvantages to the use of PWA printheads. Namely the cost associated with manufacturing PWA printhead die components and the subsequent cost to consumers of replacing a PWA printhead at the end of printhead life.

As such, there is a need for printing systems with increased print media throughput. In particular, there is a need for an increased print media throughput printing system that makes use of conventional, non PWA printheads that can be moved back and forth across the print media.

SUMMARY OF THE INVENTION

The present invention is a printing system for depositing marking fluid on print media. The printing system includes first and second marking engines. The first marking engine deposits a first marking fluid only on a first portion of the print media. The second marking engine deposits a second marking fluid only on a second portion of the print media that is different than the first portion.

BRIEF DESCRIPTION OF THE DRAWINGS

The accompanying drawings are included to provide a further understanding of the present invention and are incorporated in and constitute a part of this specification. The drawings illustrate the embodiments of the present invention and together with the description serve to explain the principals of the invention. Other embodiments of the present invention and many of the intended advantages of the present invention will be readily appreciated as the same become better understood by reference to the following detailed description when considered in connection with the accompanying drawings, in which like reference numerals designate like parts throughout the figures thereof, and wherein.

DETAILED DESCRIPTION OF THE PREFERRED EMBODIMENTS

Figure 1:
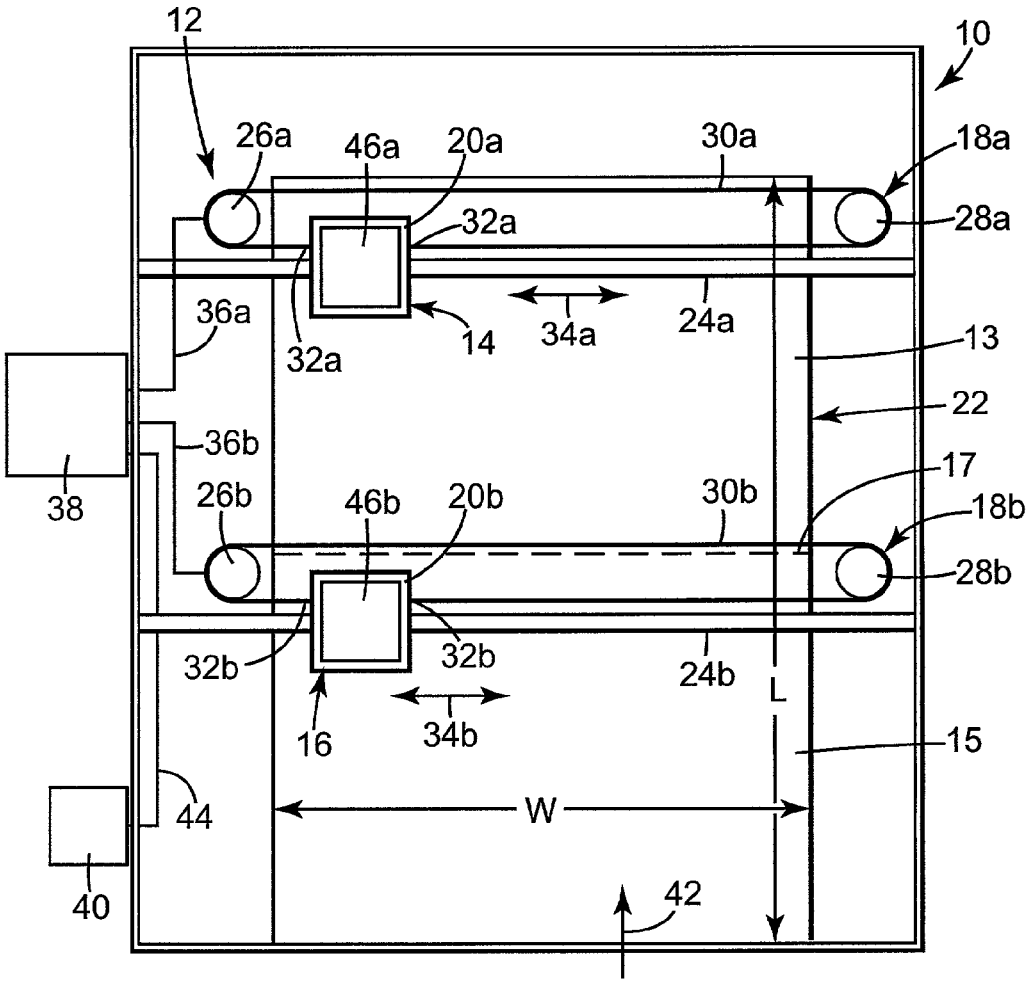
FIG. 1 is a schematic drawing of a printing system having first and second printhead assemblies for increasing print media throughput in accordance with the present invention.

FIG. 1 depicts a schematic representation of a printing system, such as a thermal inkjet printing system 10 which includes a printing mechanism 12 for enhancing (i.e., increasing) print media throughput of the printing system 10 in accordance with the present invention. The printing mechanism 12 is defined by a first marking engine or printhead assembly 14 and a second marking engine or printhead assembly 16 which is spaced from the first printhead assembly 14. The first printhead assembly 14 deposits a marking fluid, such as ink, only on a first or upper portion 13 of print media 22, such as paper, while the second printhead assembly 16 deposits a making fluid, such as ink, only on a second or lower portion 15 of the print media 22. The lower portion 15 is different than the upper portion 13. As seen in FIG. 1, a dashed line 17 represents the dividing line between the upper and lower portions 13, 15 of the print media 22.

In one preferred embodiment, the first and second printhead assemblies 14, 16 are identical, so only the first printhead assembly 14 will be described with particularity. Moreover, like parts are labeled with like numerals with the first printhead assembly 14 being designated by the subscript "a" and the second printhead assembly 16 being designated with the subscript "b".

As seen best in FIG. 1, the first printhead assembly 14 includes a first drive mechanism 18*a*. The first drive mechanism 18*a* is defined by a carriage 20*a* linearly movable back and forth across the print media 22. The carriage 20*a* linearly moves along and is therefore guided by a linear guide rod 24*a* mounted to the printing system 10. The first drive mechanism 18*a* is further defined by a drive motor, such as stepper motor 26*a* which is spaced from a pulley 28*a*. A drive element, such as a drive belt 30*a* extends about the stepper motor 26*a* and the pulley 28*a*. Free ends 32*a* of the drive belt 30*a* are coupled to the carriage 20*a*. Operation of the stepper motor 26*a* causes movement of the drive belt 30*a*, and thereby linear movement (as represented by double headed arrow 34*a*) of the carriage 20*a* along the linear guide rod 24*a* back and forth across the print media 22. The stepper motors 26*a*, 26*b* of the first and second drive mechanisms 18*a*, 18*b* of the first and second printhead assemblies 14, 16, respectively, are linked by signal transmission lines 36*a*, 36*b* to printing system control electronics 38. The control electronics 38 control movement of the carriages 20*a*, 20*b* via the stepper motors 26*a*, 26*b* in accordance with the print job to be performed on the print media 22 by the first and second printhead assemblies 14, 16.

As seen best in FIG. 1, the printing system 10 further includes a print media feed mechanism 40 for linearly moving the print media 22, in a known manner, in only a first direction, as represented by feed arrow 42, relative to the first and second printhead assemblies 14, 16. The print media 22 moves in a direction substantially perpendicular to the directions of movement of the first and second printhead assemblies 14, 16. The print media feed mechanism 40 is coupled to the control electronics 38 via a signal transmission line 44. The control electronics 38 control movement of the print media 22 via the print media feed mechanism 40 in accordance with the print job to be performed on the print media 22 by the first and second printhead assemblies 14, 16.

Figure 2:
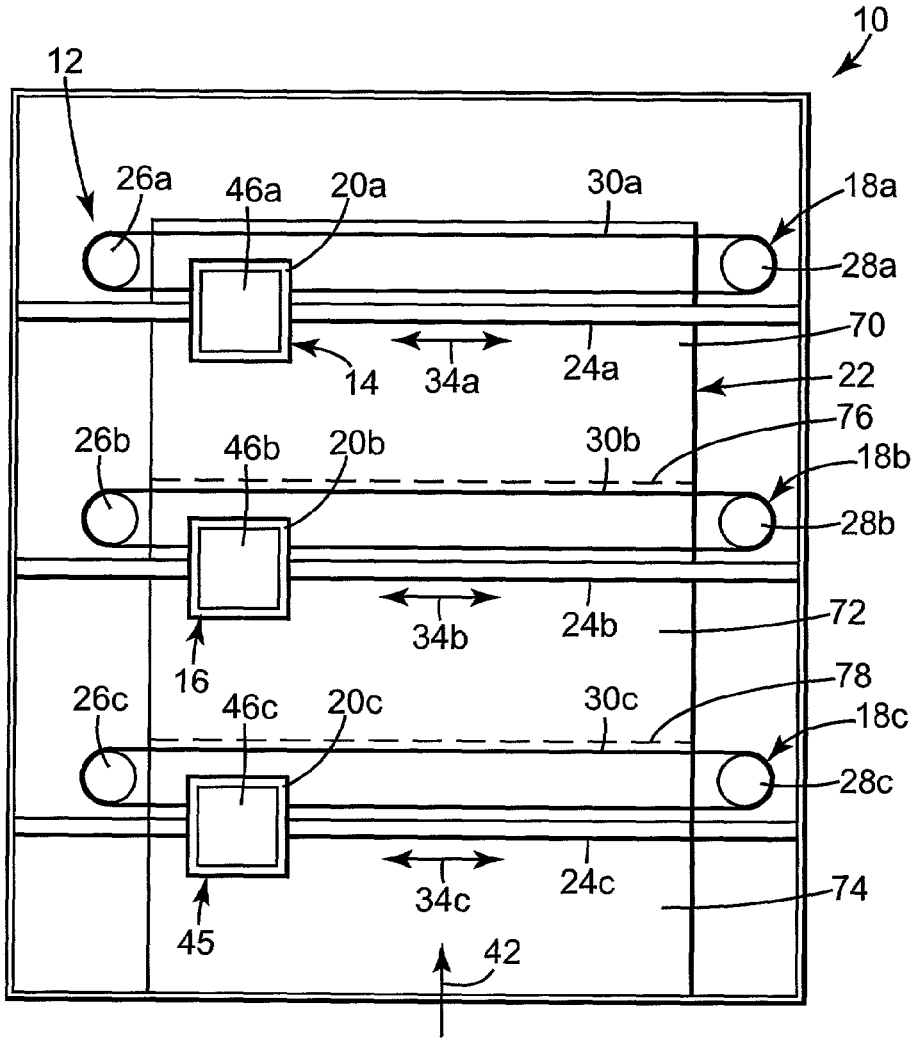
FIG. 2 is a schematic drawing of an alternative printing system having first, second and third printhead assemblies for increasing print media throughput in accordance with the present invention.

Although, in one preferred embodiment, the printing system 10 is illustrated as including only first and second printhead assemblies 14, 16. It is to be understood that the printing system 10 could include more than two printhead assemblies. For example, alternatively as illustrated in FIG. 2, the printing system 10 could include the first and second printhead assemblies 14, 16 and a third printhead assembly 45. The third printhead assembly 45 is identical to the first and second printhead assemblies 14, 16 as such like elements in FIG. 2 are labeled with like numerals with the inclusion of the subscript "c" designating the components of the third printhead assembly 45.

Figure 3:
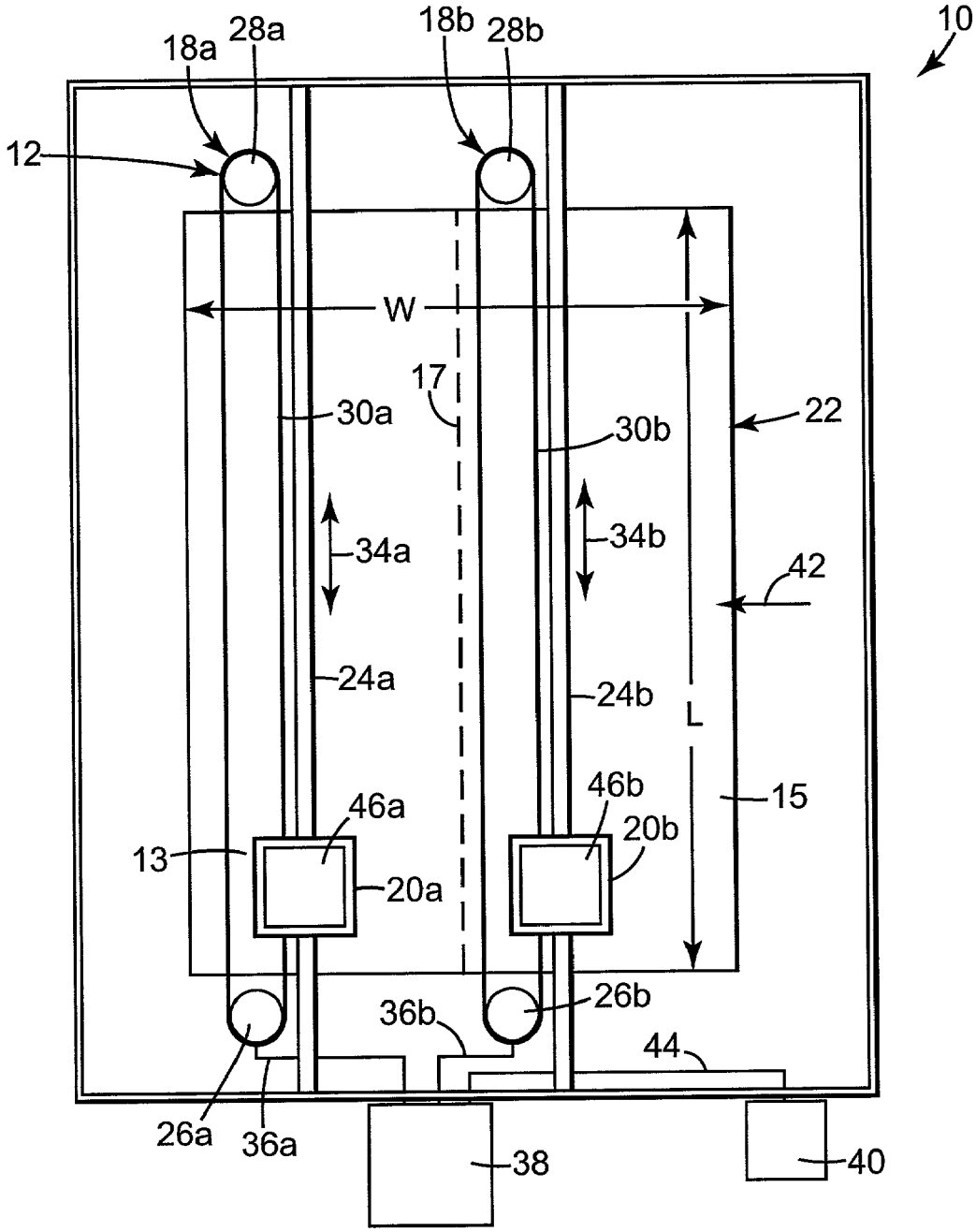
FIG. 3 is a schematic drawing of a further alternative printing system having first and second printhead assemblies that scan across a length dimension of print media.

The print media 22 has a width dimension "W" and a length dimension "L" which is greater than the width dimension "W" (see FIG. 1). In one preferred embodiment illustrated in FIG. 1, the first and second drive mechanisms 18*a*, 18*b* move the carriages 20*a*, 20*b* of the first and second printhead assemblies 14, 16 back and forth across the width dimension "W" of the print media 22. In an alternative embodiment illustrated in FIG. 3, the first and second drive mechanisms 18*a*, 18*b* move the carriages 20*a*, 20*b* of the first and second printhead assemblies 14, 16 back and forth across the length dimension "L" of the print media 22.

Figure 4:
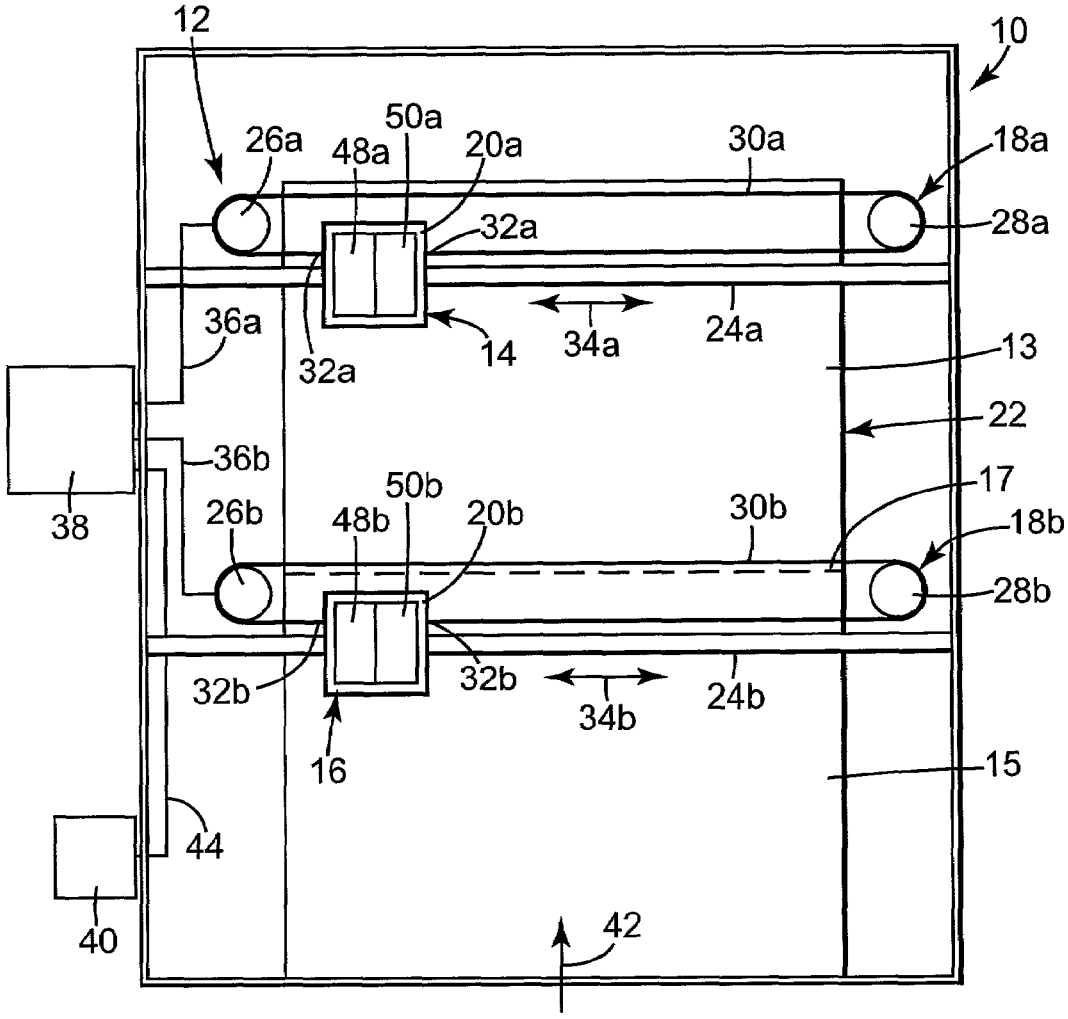
FIG. 4 is a schematic drawing similar to FIG. 1 illustrating another alternative printing system in which each of the first and second printhead assemblies includes two printheads.
Figure 5:
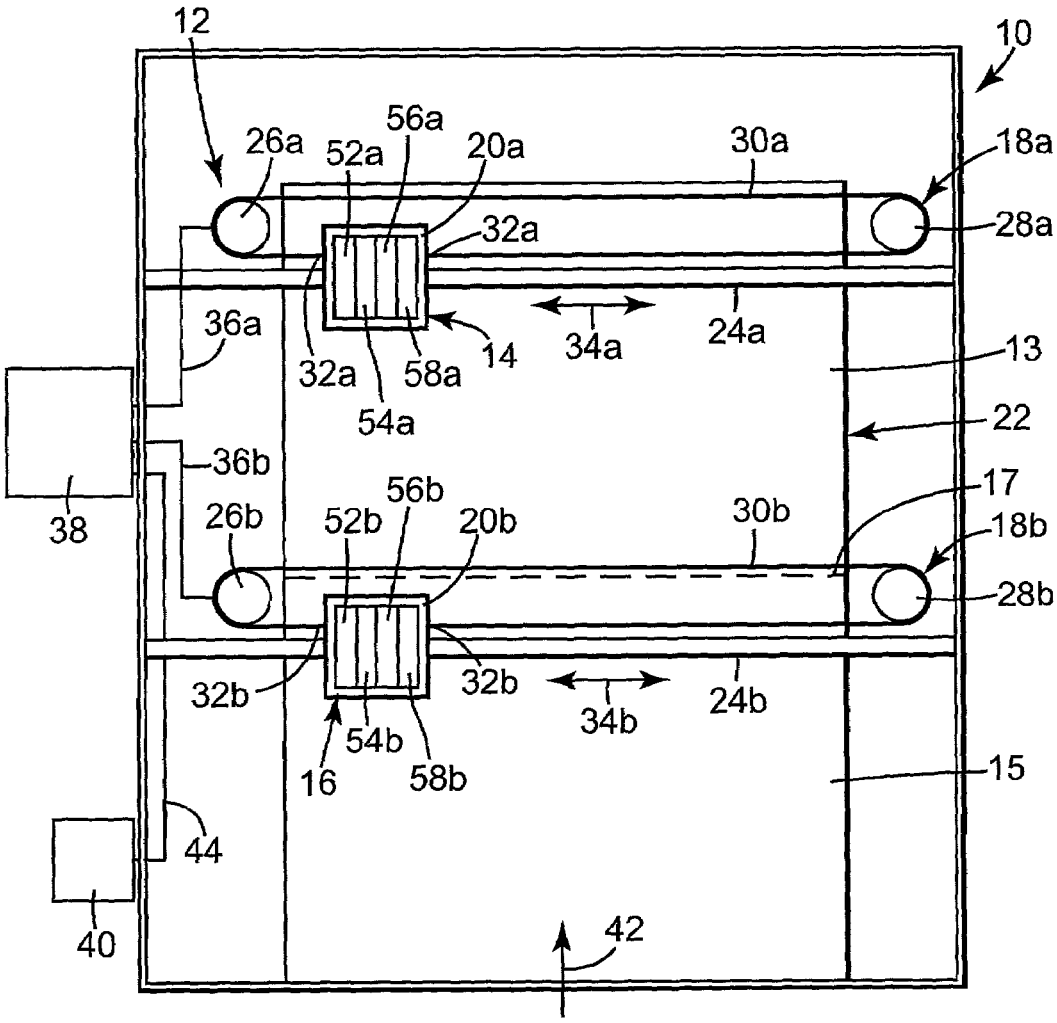
FIG. 5 is a schematic drawing similar to FIG. 1 illustrating still another alternative printing system in which each of the first and second printhead assemblies includes four printheads.

As previously stated, in one preferred embodiment, the first and second printhead assemblies 14, 16 are identical. In this one preferred embodiment, each of the carriages 20*a*, 20*b* carries a single replaceable printhead 46*a*, 46*b* for printing multiple colors of marking fluid, such as ink. The multiple colors of ink in the single printhead 46*a* of the first printhead assembly 14 are identical to the multiple colors of ink in the single printhead 46*b* of the second printhead assembly 16. These multiple colors of ink are black, cyan, magenta and yellow. Alternatively, the single printhead 46*a* of the first printhead assembly 14 could include ink of different colors or composition than the colors of ink and ink composition of the single printhead 46*b* of the second printhead assembly 16. As a further alternative, the single printhead 46*a* of the first printhead assembly 14 and the single printhead 46*b* of the second printhead assembly 16 could each include only a single color of ink. That single color of ink could be black. As still a further alternative as illustrated in FIG. 4, each of the carriages 20*a*, 20*b* can carry a first replaceable printhead 48*a*, 48*b*, and a second replaceable printhead 50*a*, 50*b*. The first printhead 48*a*, 48*b* would print a single color of ink, such as black, while the second printhead 50*a*, 50*b* would print multiple colors of ink, such as cyan, magenta and yellow. As another alternative as illustrated in FIG. 5, each of the carriages 20*a*, 20*b* can carry a first replaceable printhead 52*a*, 52*b*, a second replaceable printhead 54*a*, 54*b*, a third replaceable printhead 56*a*, 56*b*, and a fourth replaceable printhead 58*a*, 58*b*. The first printhead 52*a*, 52*b* would print a single color of ink, such as black, the second printhead 54*a*, 54*b* would print a single color of ink, such as cyan, the third printhead 56*a*, 56*b* would print a single color of ink, such as magenta, and the fourth printhead 58*a*, 58*b* would print a single color of ink, such as yellow.

Figure 6A:
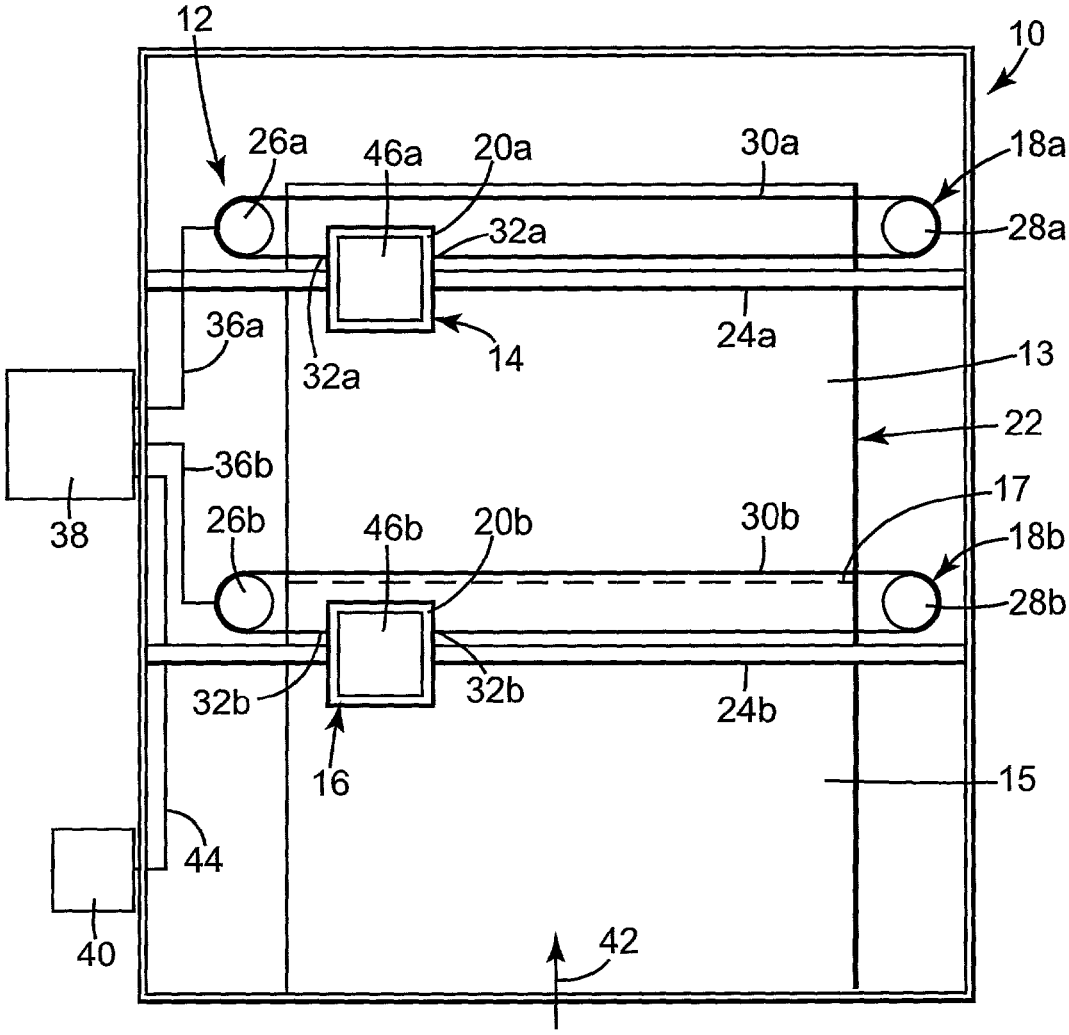
FIGS. 6A–6F illustrate the operation of the printing system of FIG. 1 to perform a print job in accordance with the present invention.
Figure 6B:
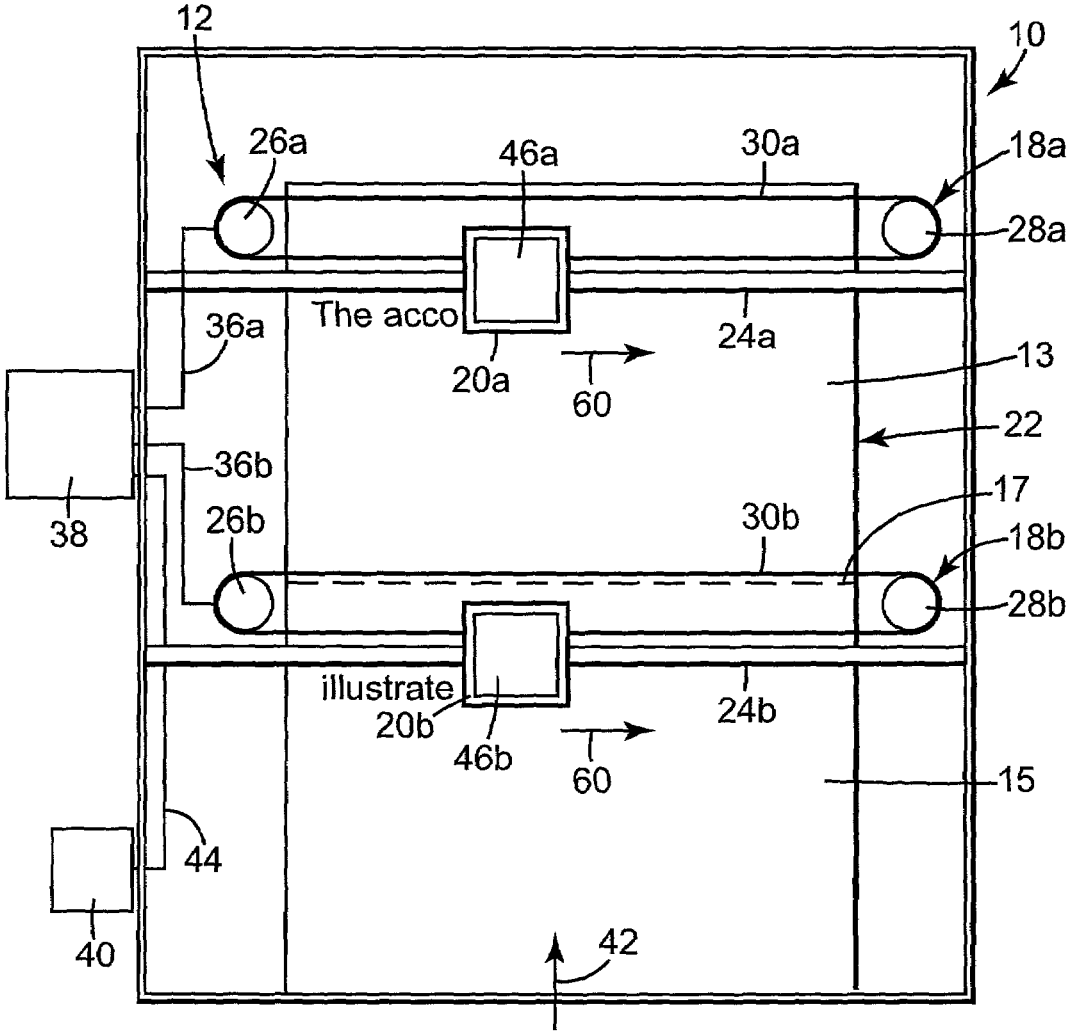

Operation, in accordance with the present invention, of the first and second printhead assemblies 14, 16 of the printing system 10 shown in FIG. 1, is illustrated in FIGS. 6A–6F. FIG. 6A illustrates the print media 22 in the printing system 10 in position to be printed upon (i.e., ready for the creation of text, characters and/or illustrations) by the first and second printhead assemblies 14, 16 in accordance with a print job. FIG. 6B illustrates the beginning of linear movement (see arrow 60) of the carriages 20*a*, 20*b* of the first and second printhead assemblies 14, 16 along the linear guide rods 24*a*, 24*b* of the first and second drive mechanisms 18*a*, 18*b* and the creation of text as a result of the ejection of ink droplets from printheads 46*a*, 46*b* as directed by the control electronics 38 in accordance with the print job. As can be seen in FIG. 6B (as well as subsequent FIGS. 6C–6F), in one preferred embodiment, the control electronics 38 control movement of the first and second printhead assemblies 14, 16 so that the printhead assemblies 14, 16 move in unison (i.e., together) back and forth across the width dimension "W" of the print media 22. In other words, the first and second printhead assemblies 14, 16 start movement across the print media 22 at the same time, the first and second printhead assemblies 14, 16 move across the print media in the same direction, the first and second printhead assemblies 14, 16 move back and forth across the print media 22 at the same speed, and the first and second printhead assemblies 14, 16 stop movement at the same time. Alternatively, as represented by the dashed outline of the second printhead assembly 16 in FIG. 6B, the second printhead assembly 16 can operate independently of the first printhead assembly 14. In other words, the second printhead assembly 16 can start and stop movement at a different time, can move at a different speed, and/or can move in a different direction than the first printhead assembly 14.

Figure 6C:
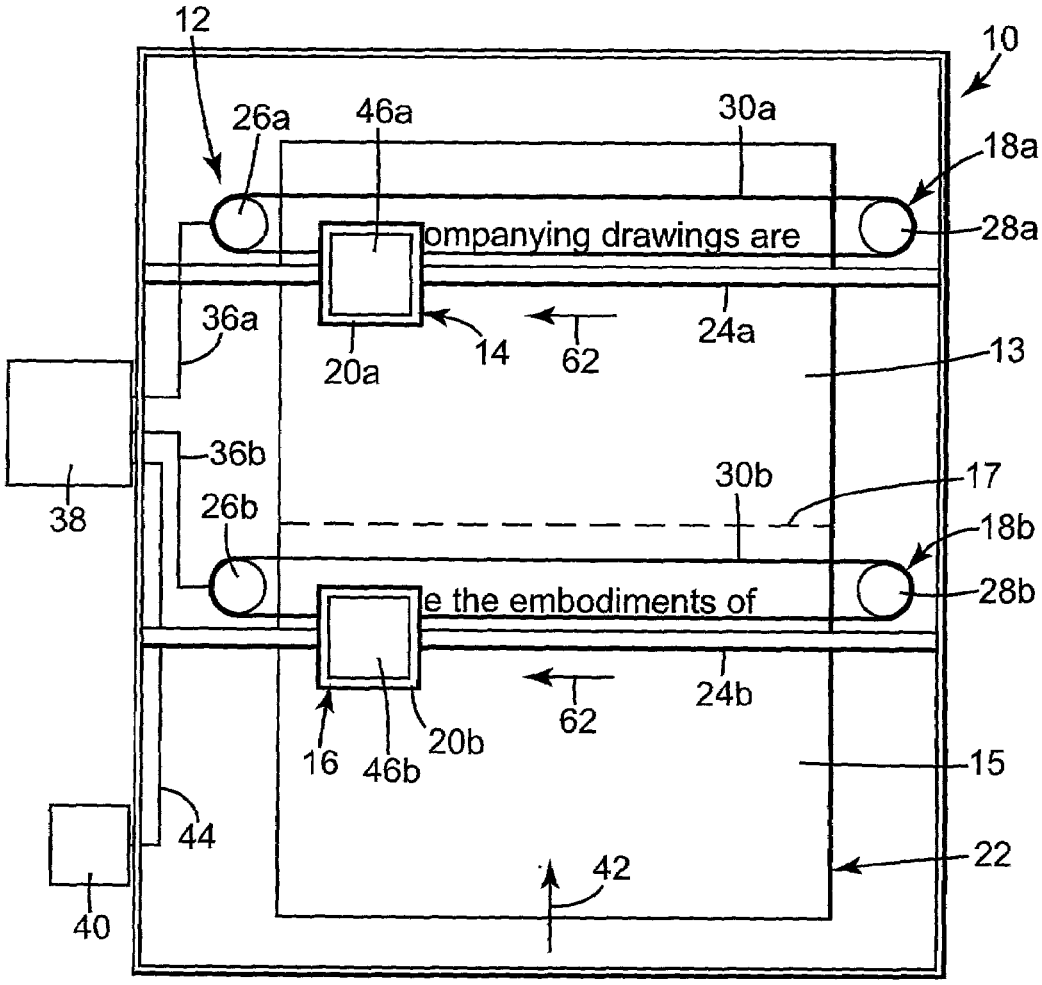
Figure 6D:
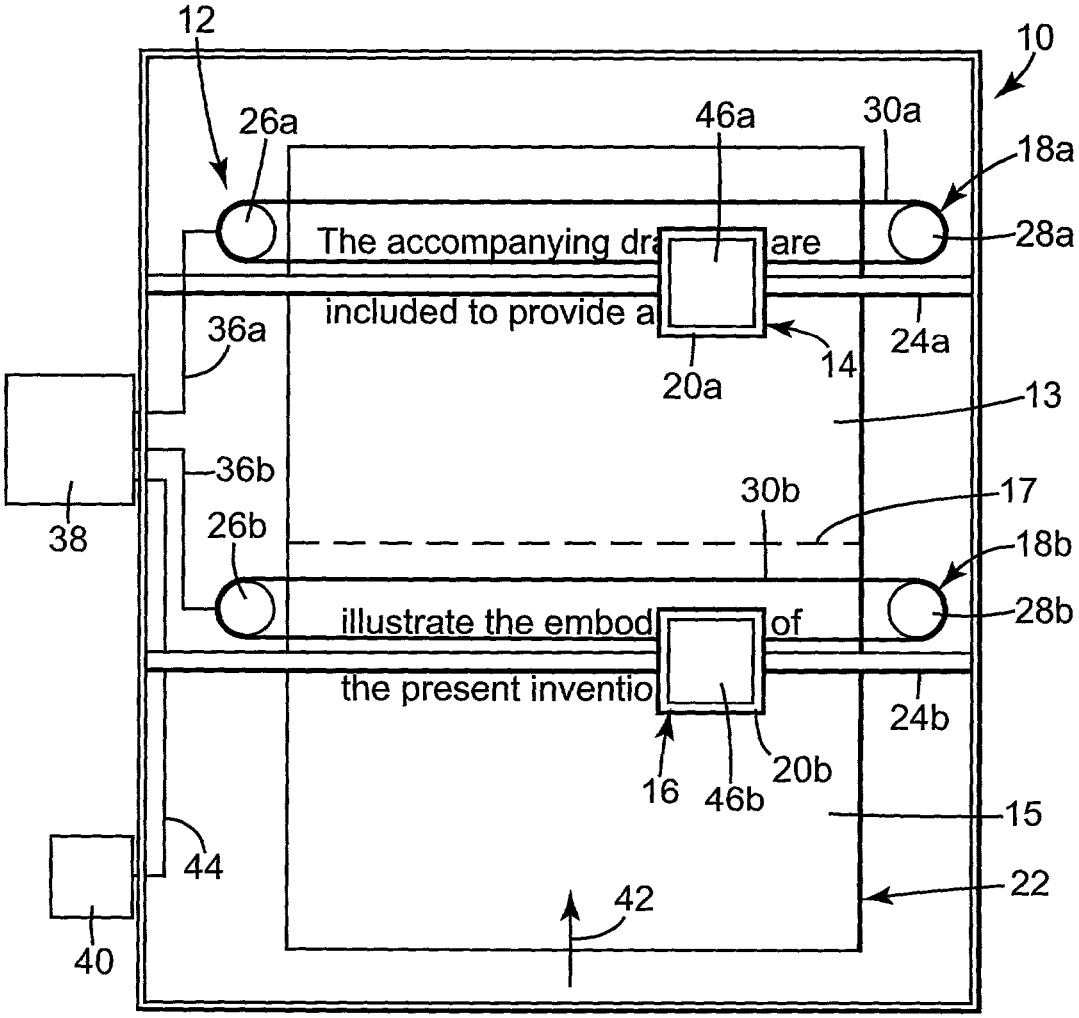
Figure 6E:
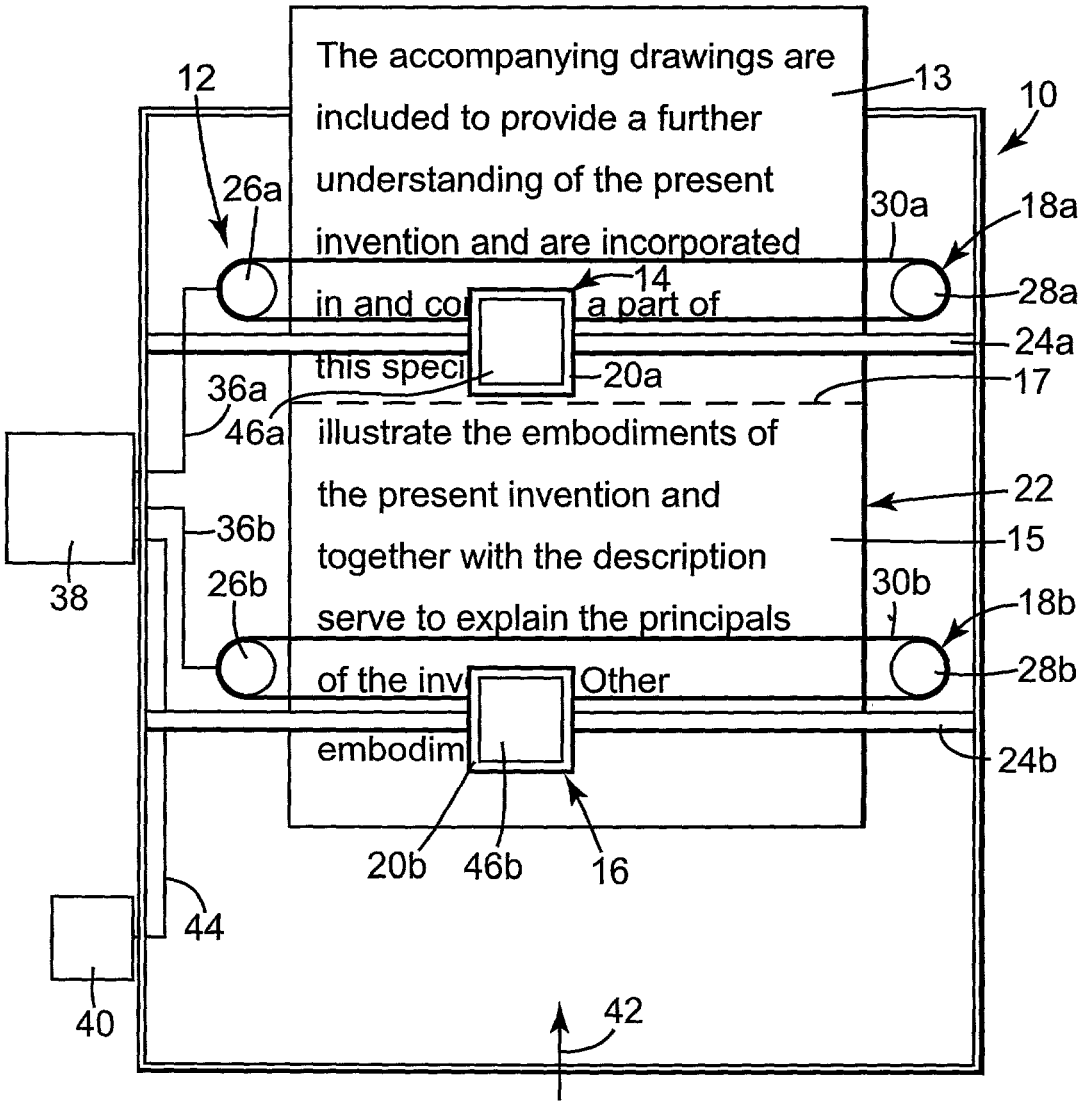
Figure 6F:
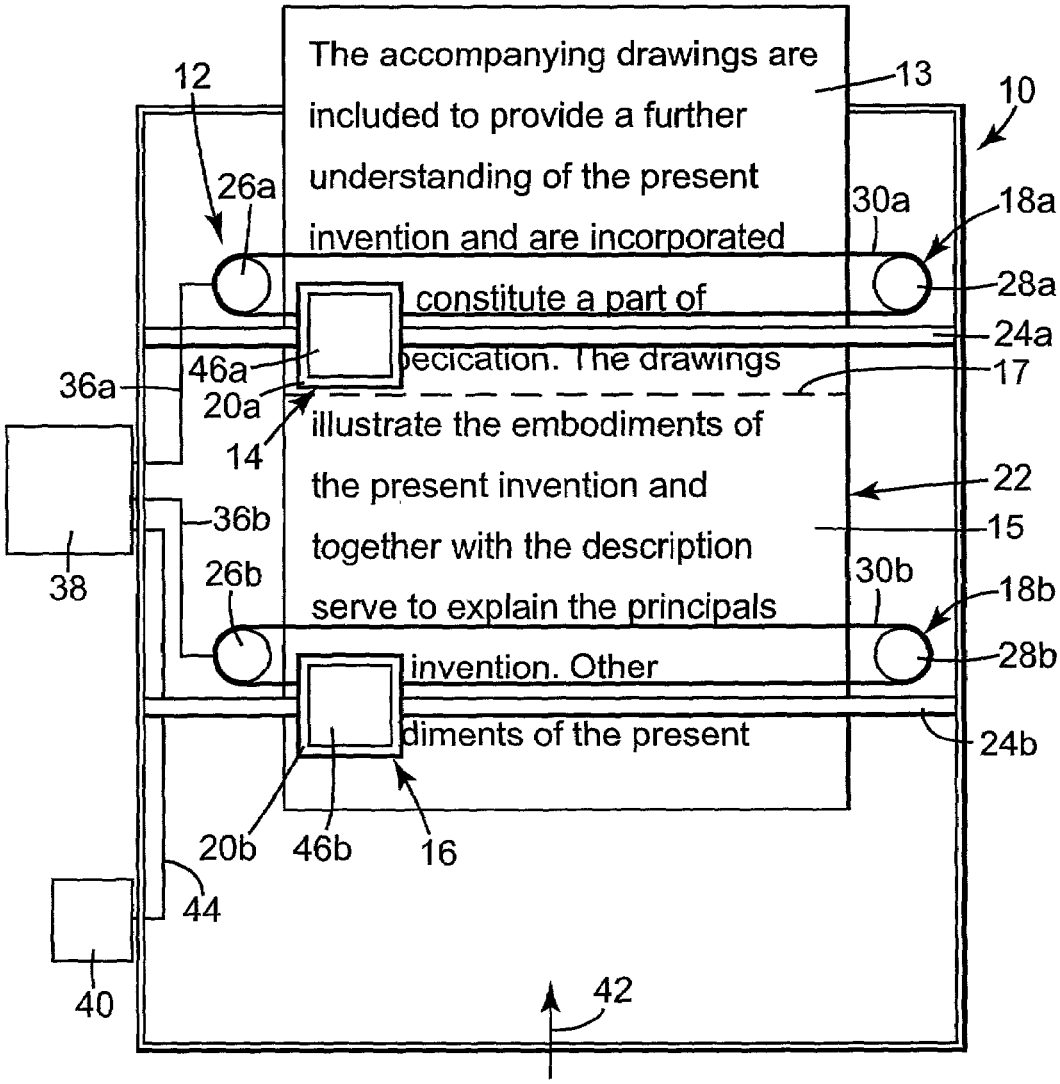

FIG. 6C illustrates the completion of first lines of text produced by printheads 46*a*, 46*b* of the first and second printhead assemblies 14, 16, the completion of linear movement (see arrow 62) of the carriages 20*a*, 20*b* of the printhead assemblies 14, 16 back along the linear guide rods 24*a*, 24*b* of the first and second drive mechanisms 18*a*, 18*b*, and the advance of the print media 22 along the direction 42 as a result of operation of the print media feed mechanism 40 so that second lines of text can be printed upon the print media 22. FIG. 6D illustrates the formation of these second lines of text as a result of movement of the printhead assemblies 14, 16 and operation of the printheads 46*a*, 46*b*. FIG. 6E illustrates the formation of further lines of text due to movement of the first and second printhead assemblies back and forth across the print media 22 and operation of the printheads 46*a*, 46*b*. FIG. 6F illustrates the completion of the print job. As can be readily seen when viewing FIGS. 6B–6E, the first printhead assembly 14 deposits ink only on the upper portion 13 of print media 22, while the second printhead assembly 16 deposits ink only on the lower portion 15 of the print media 22. The control electronics 38 controls the print media feed mechanism 40 and the first and second drive mechanisms 18*a*, 18*b* to insure that the printhead 46*a* deposits ink only on the upper portion 13 and the printhead 46*b* deposits ink only on the lower portion 15. As can be readily understood, the use of two scanning printhead assemblies 14, 16 doubles the print media throughput of a conventional printing system that employs only a single scanning printhead assembly. In other words, the print media throughput of the printing system 10 is increased over a conventional printing system having a single scanning printhead assembly by a factor of "n", where "n" is the number of printhead assemblies.

The dashed line 17 represents the dividing line between the upper and lower portions 13, 15 of the print media 22, with these upper and lower portions 13, 15 being equal in one preferred embodiment. Alternatively, the lower portion 15 could be larger than the upper portion 13 (see the dotted line 66 in FIG. 6E). In this alternative version the printhead 46*b* would assume a greater print burden of the print job with the printhead 46*a* being shut off during one or more of its passes. For example, if the print job consisted of only three lines of text equally spaced along the print media 22, the printhead 46*a* would print the first line of text at the same time the printhead 46*b* prints the second line of text. The third line of text would be printed by the printhead 46*b* while the printhead 46*a* would make a non printing pass across the print media 22. This process may be useful for printing of certain types of illustrations.

With regards to FIG. 2 and the inclusion of the third printhead assembly 45, it is to be understood that the first printhead assembly 14 would deposit ink only a first portion 70 of print media 22, the second printhead assembly 16 would deposit ink only on a second portion 72 of the print media 22, while the third printhead assembly 45 would deposit ink only on a third portion 74 of the print media 22. Dashed lines 76 and 78 represent the dividing lines between these first, second and third portions 70, 72, 74 of the print media 22, with these first, second and third portions 70, 72, 74 being equal in size. As can be readily understood, the use of three scanning printhead assemblies 14, 16, 45 triples the print media throughput of a conventional printing system that employs only a single scanning printhead assembly.

The printing system 10 makes use of multiple conventional, non PWA printhead assemblies 14, 16 (45) to increase the print media throughput of the printing system 10. In particular, the printing system uses at least first and second printhead assemblies 14, 16, with each printhead assembly being movable back and forth across the print media 22 to deposit ink on different portions 13, 15 of the print media 22 at the same time. This greatly increases the print media throughput of the printing system 10 especially compared to conventional printing systems employing a single printhead assembly movable relative to print media.

Although the present invention has been described with reference to preferred embodiments, workers skilled in the art will recognize that changes may be made in form and detail without departing from the spirit and scope of the invention.

What is claimed is:

1. A printing system for depositing marking fluid on print media, the printing system comprising:

a first marking engine for depositing a first marking fluid only on a first portion of a first side of the print media; and a second marking engine for depositing a second marking fluid only on a second portion of the first side of the print media different than the first portion, wherein the first marking engine is excluded from depositing the first marking fluid on the second portion of the print media and the second marking engine is excluded from depositing the second marking fluid on the first portion of the print media, wherein the first marking engine and the second marking engine are adapted to move back and forth across to print media along a first direction while depositing the respective first and second marking fluid on the respective first and second portion of the print media along the first direction.

2. The printing system of claim 1 wherein the printing system further includes:

a first mechanism coupled to the first marking engine for moving the first marking engine back and forth across the print media so that the first marking engine can deposit the first marking fluid only on the first portion of the print media; and a second mechanism coupled to the second marking engine for moving the second marking engine back and forth across the print media so that the second marking engine can deposit the second marking fluid only on the second portion of the print media.

3. The printing system of claim 2 wherein the first mechanism is spaced from the second mechanism.

4. The printing system of claim 2 wherein the first and second mechanisms are identical.

5. The printing system of claim 4 wherein each of the first and second mechanisms includes:

a linear guide rod for guiding the respective first and second marking engine;

a drive motor; and a drive element coupled between drive motor and the respective first and second marking engine, the drive motor through the drive element linearly moving the respective first and second marking engine along the linear guide rod back and forth across the print media.

6. The printing system of claim 2 wherein the print media has a width dimension and a length dimension which is greater than the width dimension, and wherein the first and second mechanisms move the first and second marking engines, respectively, back and forth across the width dimension of the print media.

7. The printing system of claim 2 wherein the print media has a width dimension and a length dimension which is greater than the width dimension, and wherein the first and second mechanisms move the first and second marking engines, respectively, back and forth across the length dimension of the print media.

8. The printing system of claim 2 wherein the first and second mechanisms operate in unison to move the first and second marking engines back and forth across the print media.

9. The printing system of claim 2 wherein the first and second mechanisms operate independently of one another to move the first and second marking engines back and forth across the print media.

10. The printing system of claim 1 wherein the first and second marking fluids are the same.

11. The printing system of claim 1 wherein the first and second marking fluids are different.

12. The printing system of claim 1 wherein the first and second marking engines are identical.

13. The printing system of claim 12 wherein each of the first and second marking engines includes a printhead for printing a single color marking fluid.

14. The printing system of claim 12 wherein each of the first and second marking engines includes a printhead for printing multiple colors of marking fluid.

15. The printing system of claim 12 wherein each of the first and second marking engines includes a first printhead and at least a second printhead.

16. The printing system of claim 15 wherein the first printhead prints a single color of marking fluid and the at least a second printhead prints at least a single color of marking fluid that is different than the single color of marking fluid of the first printhead.

17. The printing system of claim 16 wherein the at least a single color of marking fluid is multiple colors of marking fluid.

18. The printing system of claim 1 wherein the printing system is a thermal inkjet printing system.

19. The printing system of claim 1 wherein the second marking engine is spaced from the first marking engine in a second direction substantially perpendicular to the first direction.

20. The printing system of claim 19 wherein the first marking engine is adapted to deposit the first marking fluid to a first side of a dividing line between the first portion and the second portion of the print media, and the second marking engine is adapted to deposit the second marking fluid to a second side of the dividing line, and wherein the dividing line is substantially parallel to the first direction.

21. The printing system of claim 1 wherein the first marking engine is adapted to move back and forth across the print media along a first axis, and the second marking engine is adapted to move back and forth across the print media along a second axis spaced from the first axis.

22. An inkjet printing system for depositing ink on print media, the printing system comprising:

a first mechanism for moving a first printhead assembly relative to the print media so that the first printhead assembly can deposit ink only on a first unprinted portion of a first side of the print media along a first direction while the first printhead assembly moves back and forth across the print media along the first direction; and a second mechanism, separate from the first mechanism, for moving a second printhead assembly, separate from the first printhead assembly, relative to the print media so that the second printhead assembly can deposit ink only on a second imprinted portion of the first side of the print media along the first direction while the second printhead assembly moves back and forth across the print media along the first direction.

23. The inkjet printing system of claim 22 wherein the first and second mechanisms operate in unison to move the first and second printhead assemblies relative to the print media at the same speed.

24. The inkjet printing system of claim 22 wherein the first and second mechanisms operate in unison to move the first and second printhead assemblies relative to the print media at the same time.

25. The inkjet printing system of claim 22 wherein the first and second mechanisms operate in unison to move the first and second printhead assemblies relative to the print media in the same direction.

26. The inkjet printing system of claim 22 wherein the first and second mechanisms operate in unison to move the first and second printhead assemblies relative to the print media at the same speed, at the same time and in the same direction.

27. The inkjet printing system of claim 22 wherein the first and second mechanisms operate independently of one another to move the first and second printhead assemblies relative to the print media at different speeds.

28. The inkjet printing system of claim 22 wherein the first and second mechanisms operate independently of one another to move the first and second printhead assemblies relative to the print media at different times.

29. The inkjet printing system of claim 22 wherein the first and second mechanisms operate independently of one another to move the first and second printhead assemblies relative to the print media in different directions.

30. The inkjet printing system of claim 22 wherein the first and second mechanisms operate independently of one another to move the first and second printhead assemblies relative to the punt media at different speeds, at different times and in different directions.

31. The inkjet printing system of claim 22 and further including:

a third mechanism, separate from the first and second mechanisms, for moving a third printhead assembly, separate from the first and second printhead assemblies, relative to the print media so that the third printhead assembly can deposit ink only on a third portion of the first side of the print media different than the first and second portions of the print media along the first direction while the third printhead assembly moves back and forth across the print media along the first direction.

32. The inkjet printing system of claim 22 wherein the second mechanism is spaced from the first mechanism in a second direction substantially perpendicular to the first direction.

33. The inkjet printing system of claim 32 wherein the first mechanism moves the first printhead assembly so that the first printhead assembly can deposit ink only to a first side of a dividing line between the first portion and the second portion of the print media, and the second mechanism moves the second printhead assembly so that the second printhead assembly can deposit ink only to a second side of the dividing line, and wherein the dividing line is substantially parallel to the first direction.

34. The inkjet printing system of claim 22 wherein the first mechanism moves the first printhead assembly back and forth across the print media along a first axis, and the second mechanism moves the second printhead assembly back and forth across the print media along a second axis spaced from the first axis.

35. A method for performing a printing operation for depositing ink on print media, the method comprising:

providing a first movable printhead assembly for depositing ink on the print media;

providing a second movable printhead assembly for depositing ink on the print media;

before depositing any ink on the print media with either of the first and second printhead assemblies, positioning of the print media for printing on a first portion of a first side thereof with the first printhead assembly and for printing on a second portion of the first side thereof different than the first portion with the second printhead assembly; and after the positioning of the print media, moving the first and second printhead assemblies back and forth across the print media along a first direction while the first printhead assembly deposits ink only on the first portion of the print media along the first direction and the second printhead assembly deposits ink only on the second portion of the print media along the first direction.

36. The method of claim 35 wherein moving the first and second printhead assemblies includes:

moving the first and second printhead assemblies in unison back and forth across the print media.

37. The method of claim 35 wherein moving the first and second printhead assemblies includes:

moving the first and second printhead assemblies independently of one another back and forth across the print media.

38. The method of claim 35 wherein the print media has a width dimension and a length dimension which is greater than the width dimension, and wherein moving the first and second printhead assemblies includes:

moving the first and second printhead assemblies back and forth across the width dimension of the print media.

39. The method of claim 35 wherein the print media has a width dimension and a length dimension which is greater than the width dimension, and wherein moving the first and second printhead assemblies includes:

moving the first and second printhead assemblies back and forth across the length dimension of the print media.

40. The method of claim 35 wherein providing the first and second printhead assemblies includes:

spacing the second printhead assembly from the first printhead assembly in a second direction substantially perpendicular to the first direction.

41. The method of claim 40 wherein moving the first and second printhead assemblies includes:

moving the first and second printhead assemblies back and forth across the print media while the first printhead assembly deposits ink only to a first side of a dividing line between the first portion and the second portion of the print media and the second printhead assembly deposits ink only to a second side of the dividing line, and wherein the dividing line is substantially parallel to the first direction.

42. The method of claim 35 wherein moving the first and second printhead assemblies includes:

moving the first printhead assembly back and forth across the print media along a first axis, and moving the second printhead assembly back and forth across the print media along a second axis spaced from the first axis.

43. A system for printing on print media, the system comprising:

means for moving across the print media along a first direction and depositing a first marking fluid only on a first portion of a first side of the print media along the first direction;

means for moving across the print media along the first direction and depositing a second marking fluid only on a second portion of the first side of the print media different than the first portion along the first direction; and means for moving the print media in a second direction substantially perpendicular to the first direction, wherein before either of the means for moving across the print media and depositing the first marking fluid deposits any of the first marking fluid and the means for moving across the print media and depositing the second marking fluid deposits any of the second marking fluid, the means for moving the print media positions the first portion of the print media for printing thereon by the means for moving across the print media and depositing the first marking fluid and positions the second portion of the print media for printing thereon by the means for moving across the print media and depositing the second marking fluid.

* * * * *

UNITED STATES PATENT AND TRADEMARK OFFICE

CERTIFICATE OF CORRECTION

PATENT NO. : 6,984,014 B2
APPLICATION NO. : 10/057619
DATED : January 10, 2006
INVENTOR(S) : Baiges It is certified that error appears in the above-identified patent and that said Letters Patent is hereby corrected as shown below:

In column 7, line 20, in Claim 1, delete “to” and insert -- the --, therefor.

In column 8, line 60, in Claim 22, delete “imprinted” and insert -- unprinted --, therefor.

In column 9, line 29, in Claim 30, delete “punt” and insert -- print --, therefor.

Signed and Sealed this

Twenty-seventh Day of October, 2009

David J. Kappos

David J. Kappos
*Director of the United States Patent and Trademark Office*